United States Patent [19]

Peters

[11] Patent Number: 5,059,463

[45] Date of Patent: Oct. 22, 1991

[54] FOLDING MAT AND SHELTER

[76] Inventor: Michael V. Peters, 7027 Jefferson Ave., Falls Church, Va. 22042

[21] Appl. No.: 491,591

[22] Filed: Mar. 12, 1990

[51] Int. Cl.[5] ..... A47G 9/06; B32B 3/02

[52] U.S. Cl. ..... 428/65; 428/99; 428/192; 428/193; 428/131; 5/417; 5/418; 135/95; 135/104; 135/116; 135/902

[58] Field of Search ..... 428/99, 192, 193, 131, 428/45; 5/417, 418, 420; 135/95, 99, 104, 102, 116, 902

[56] References Cited

U.S. PATENT DOCUMENTS 2,036,033 3/1936 Fisher ..... 5/418

4,512,049 4/1985 Henry ..... 5/417

4,951,333 8/1990 Kaiser et al. ..... 5/417

*Primary Examiner*—Alexander S. Thomas

*Attorney, Agent, or Firm*—Richard C. Litman

[57] ABSTRACT

A circular mat having an outer rim that is reinforced by a steel ribbon keeps its shape while laid out and also allows for ready folding and storage. Tent stakes serves to hold the mat in place and a central hole allows the insertion of an umbrella. A shelter is capable of being erected over the mat using flexible, curved tent poles that inset into a pair of three way hinged tent steaks. This shelter serves to keep out the elements when the weather turns for the worse.

11 Claims, 3 Drawing Sheets

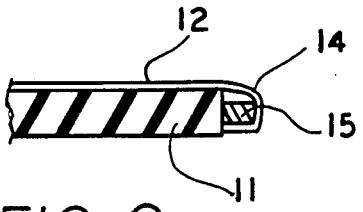
FIG. 6
FIG. 3
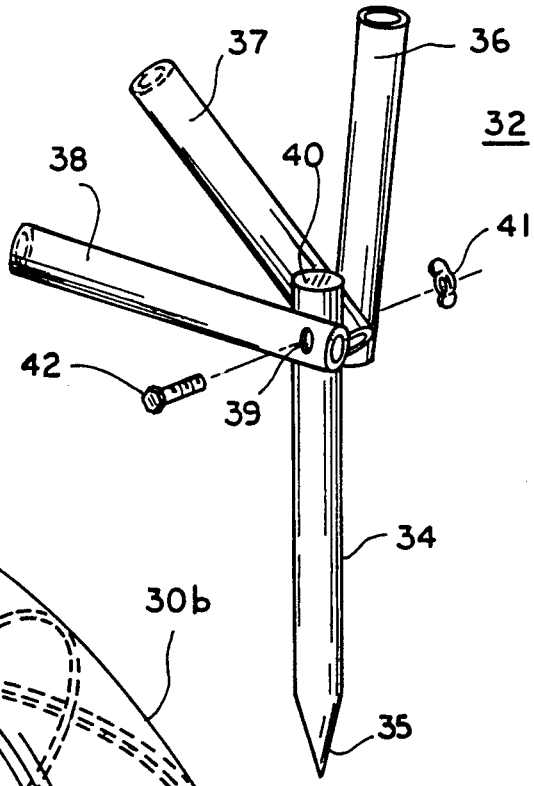
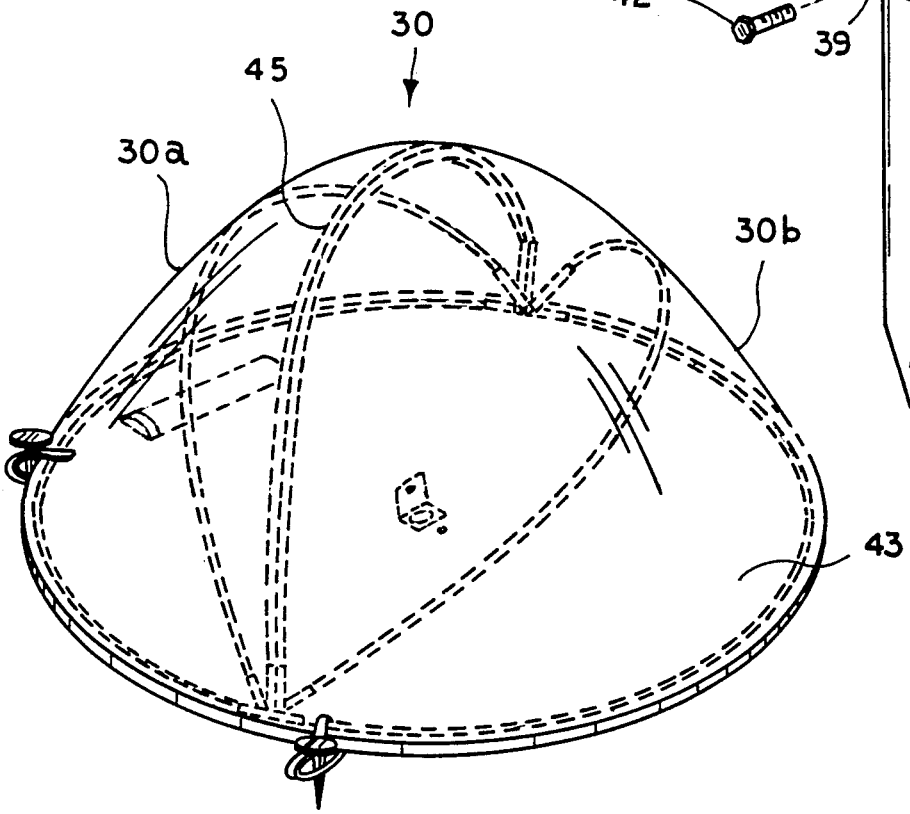
FIG. 4

FOLDING MAT AND SHELTER

BACKGROUND OF THE INVENTION

1. FIELD OF THE INVENTION

The present invention relates to towels, blankets or mats used for laying down on at a beach, picnic sight or exercising on. More particularly, it relates to towels or mats that are circular in shape and can be folded into a compact form for storage or transportation. The present invention also relates to the construction of shelters, the mat being used as a base on which to construct a shelter over the mat. This shelter would serve to protect anY-body sitting on the mat from the wind, rain or from the sun when it is desired to avoid an overexposure to its rays.

2. DESCRIPTION OF THE PRIOR ART

The following patents are felt to be related to, but do not disclose the present invention, whether taken singly or in combination.

U.S. Pat. No. 3,513,861 issued to Johnson discloses a collapsible tent having pivoting frame members.

U.S. Pat. Nos. 480,041 and 4,096,590 issued to Schlesinger and Keshock respectively, disclose hats which include flexible brim members allowing the hats to be twist folded and collapsed for storage.

U.S. Pat. No. 4,278,719 issued to Sarnecki discloses a waterproof backed towel comprised of a backing sheet of waterproof NYLON and a terrycloth cover sheet.

U.S. Pat. No. 4,599,754 issued to Mairs, III et al. discloses a combination wind screen and beach blanket apparatus.

U.S. Pat. No. 4,739,784 issued to Fast discloses a wind screen that has frame members affixed to a tent stake. The frame members pivot in relation to one another, but are not removable.

U.S. Pat. No. 4,794,029 issued to Tennant et al. discloses a round towel that converts into a handbag.

U.S. Pat. No. 4,821,353 issued to Neri discloses a folding beach mat that forms a sun shade upon folding back the mat.

U.S. Pat. No. 293,060 issued to Botbol discloses a circular towel used for sunbathing.

The above patents only disclose basic individual concepts utilized to produce the present invention. None of the above patents disclose the specific construction or application of the applicant's unique collapsible mat and shelter. Applicant also discloses a special form of tent stake that holds the frame members used for erecting the shelter over the mat that was not found in the above patents.

SUMMARY OF THE INVENTION

The present invention comprises a circular mat made of a soft foam material that is soft and comfortable to lay upon. The underside of the mat is comprised of a waterproof material that prevents moisture from soaking through to the upper side of the mat. The upper surface of the mat has upon it a layer of fabric, making it more comfortable to lay upon than just the surface of the foam. The outer edge of the mat has a flat steel or high impact plastic rim sewn into an outer pocket. This rim serves to maintain the shape of the mat. This outer rim is flexible enough to permit folding of the entire mat in a manner similar to a bandsaw blade for storage and transportation.

An additional feature includes an integral storage pouch that is part of the mat itself. A central elastic drawn aperture allows for the standing of a beach type umbrella to block the sun when it isn't desired to erect the complete shelter. The outer edge also has attached around the perimeter a plurality of stake loops through which conventional tent stakes are placed in order to hold the mat onto the ground in one position.

The invention further comprises the use of a dome shaped shelter capable of being erected over the mat. The shelter includes a number of flexible tent poles that are mounted to a pair of three way hinged tent stakes which receive the ends of the tent poles. This adjustable dome shelter serves as a quick and easy means of escaping the elements should the weather turn disagreeable while at the beach or campsite. The entire mat, and the components to the shelter, once folded, is stored and transported in a carrying case with zipper type closing. An adjustable carrying strap is affixed to the case to make transporting easier.

Accordingly, it is an object of the present invention to provide a reinforced circular mat having a waterproof underlayer.

It is another object of the present invention to provide a mat having a central elastic drawn opening for the insertion of a beach type umbrella.

It is a further object of the present invention to provide a mat having an integral storage pouch and/or pillow.

It is a yet further object of the present invention to provide stakes having means to maintain the mat in place.

It is another object of the present invention to provide a mat having an erectable shelter.

It is another object of the invention to provide a mat having a erectable shelter that is quickly collapsible and transportable.

It is a further object of the present invention to provide a mat having an erectable shelter that utilizes special hinged tent stakes that hold the frame members of the shelter.

It is a further object of the invention to have a spring steel or high impact plastic rim sewn into the mat allowing it to be collapsed in a manner similar to a bandsaw blade for easier transport.

These and other objects of the present invention will become readily apparent upon further review of the following specification and drawings.

BRIEF DESCRIPTION OF THE DRAWINGS

FIG. 3 shows a perspective view of the three way hinged tent stake.

FIG. 4 shows a perspective view of the mat with the fully erected shelter.

FIG. 6 shows a cross-section of the mat outer edge showing the hem and surrounding band.

Similar reference characters denote corresponding features consistently throughout the attached drawings.

A DETAILED DESCRIPTION OF THE PREFERRED EMBODIMENT

Figure 1:
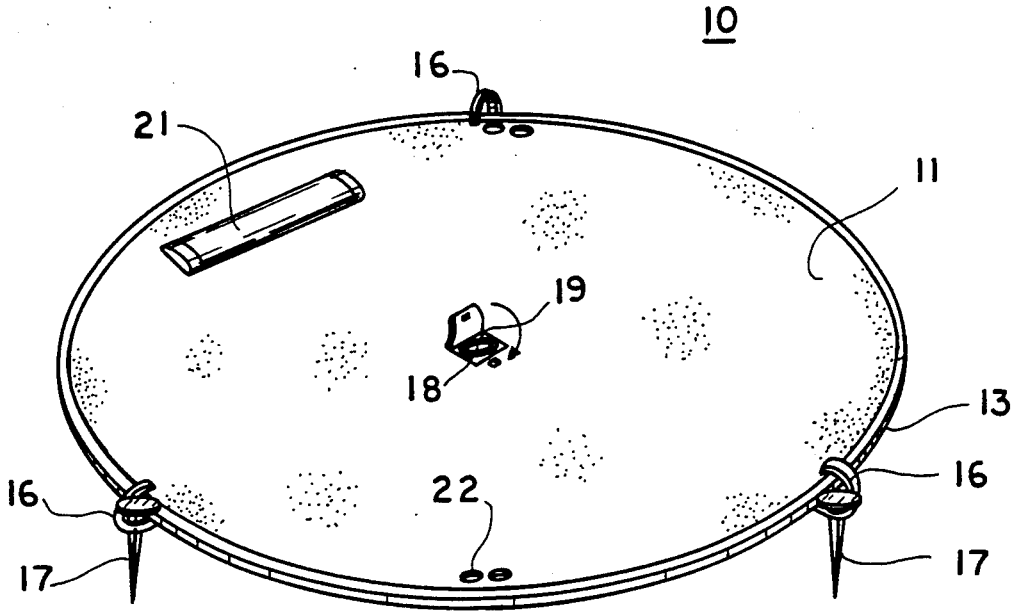
FIG. 1 shows a perspective view of the mat without the shelter.

The present invention 10 comprises a flat, circular mat 11 constructed from a soft cellular foam such as Neoprene rubber or the like. This material is useful because it is waterproof and would prevent moisture from soaking through to the top of the mat 11. It also acts as an insulator, this property is well known in diving suits made of similar material. Over the top of the Neoprene mat 11 is a laminated layer of LYCRA fabric 12 that gives a more comfortable surface to actually sit or lie upon. Around the outer edge 13 of the mat 11 is a hem 14 which is sewn around a metal band 15 as shown in FIG. 6. This band 15 serves to give the mat 11 a retained shape while it is in the unfolded position as shown in FIG. 1. The band 15 is thin enough so that the mat 11 can be folded down to ⅓ its original size without great effort. The band 15 allows the mat 11 to be collapsed similar to the way a band saw blade would be collapsed.

Placed at spaced intervals about the edge 13 of the mat 11 are tent stake loops 16 for applying tent stakes 17 through. The tent stakes 17 hold the mat in place on the ground. Disposed in the center of the mat 11 is an opening 18 that is for disposing an umbrella stand through. This opening 18 has an elastic band 19 surrounding it in order to tightlY grip the umbrella shaft to prevent any sand or dirt from coming through onto the mat 11. The opening also has a flap 20 that can cover the opening 18 when the umbrella stand is removed. This flap 20 can be secured by VELCRO or other suitable securing means.

Disposed in an integral fashion with the mat is a storage pouch 21 for holding such items as suntan lotion, wallet and sunglasses or it can serve as a pillow by stuffing it with the appropriate soft material. The circular shape of the mat as a whole allows for repositioning one's body to face the sun while sunbathing without having to move the entire mat.

Figure 2:
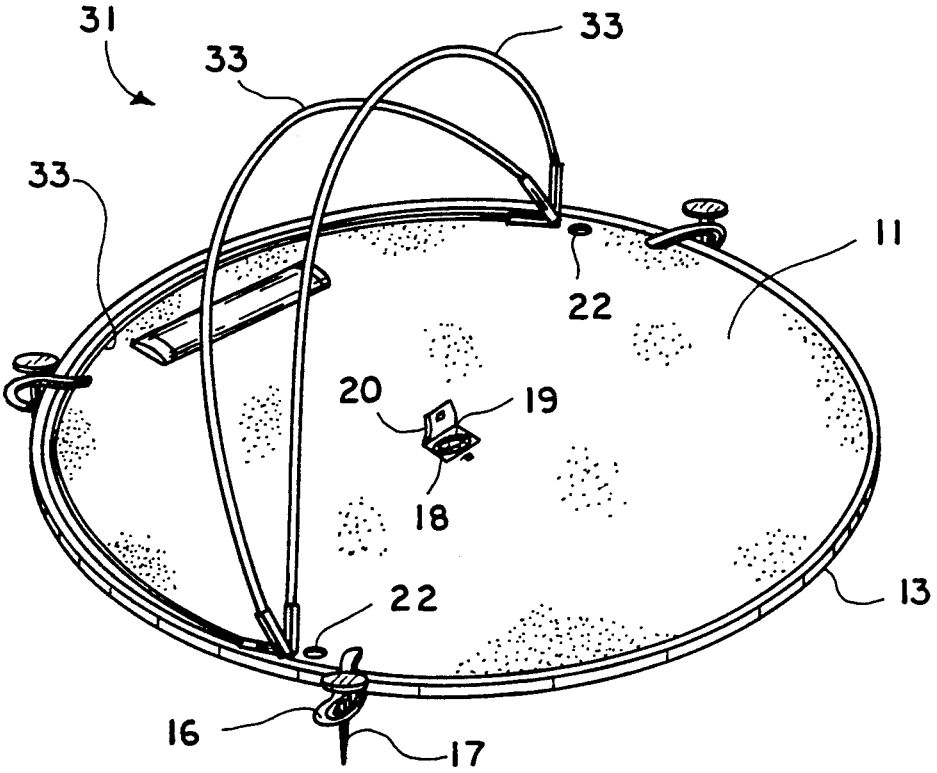
FIG. 2 shows a perspective view of the mat with the shelter frame.

The mat 11 forms the base of a shelter 30, the frame of which is shown in FIG. 2. This frame 31 is supported by a three way hinged tent stakes 32 shown in FIG. 3. This tent stake 32 supports the frame members 33 which make up the frame 31. These frame members 33 are long, shock corded, flexible tent poles that can easily be bent to be fit and locked into each of the tent stakes 32. The three way hinged tent stakes 32 are comprised of a conventional solid tent stake 34 that has the normal pointed ground insertion end 35 and three hollow holders 36,37,38 that accommodate the ends of the flexible poles 33. The three way tent stakes 32 can be made of aluminum or other suitable lightweight material. These three holders 36,37,38 are pivoted at a pivot point 39 at the opposite end 40 of the tent stake 34. This pivot point 39 can be tightened or loosened by adjusting the wing nut 41 on the bolt 42 that passes through the pivot point 39. This allows for the adjustment of the frame 31 and then locking it into position. There are four openings 22 in the mat 11 for the tent stakes 34 to be inserted through. The two pairs of three way tent stakes 32 allow for two adjacent shelter sections **30*a*,30*b*** to be erected as described below.

The flexible frame members 33 can be made of material similar to that used in a fishing pole, flexible, but strong. They can also be constructed of a plurality of hollow segments mounted over an elastic shock cord that keeps the segments together. This construction also allows for flexibility. These are offered as two possible constructions without any intent of limiting the invention to them. Over the frame 31 would go a sheet of material 43 that would form the roof of the shelter 30 secured bY VELCRO. The fully constructed shelter 30 is shown in FIG. 4. Notice that there are two separate halves **30*a*,30*b* to the shelter 30. One half can be used alone when it is desired to only to use as a wind break. Both halves can be used together when it is desired to use the shelter as a dressing room at a park or beach. The two halves 30*a*,30*b* are folded up by loosening bolt and wingnuts 41,42 and then retightening them to close the shelter 30. A strip of VELCRO along the seam 45 between the two halves 30*a*,30*b* can be used to seal the shelter 30**. Other means such as a row of snaps or a zipper are possible. Again, these are just a number of suggested embodiments without any intent to limit the invention to them.

Figure 5A:
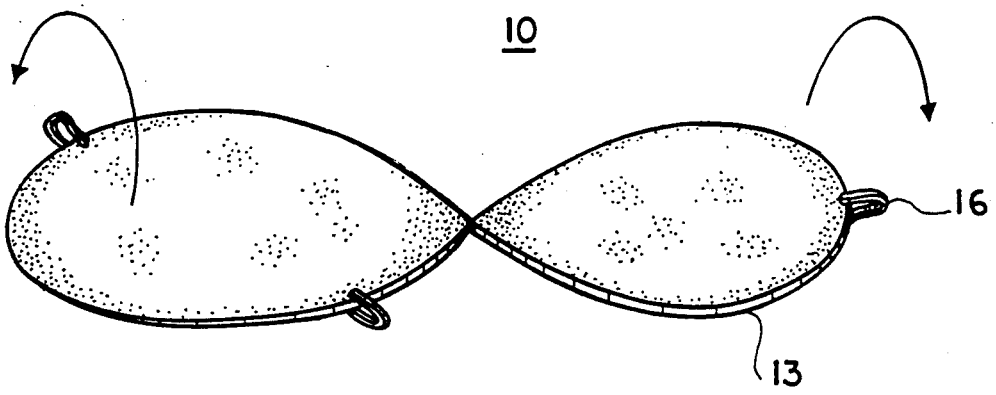
FIGS. 5*a*–5*c* shows the mat in a folded storage position.
Figure 5B:
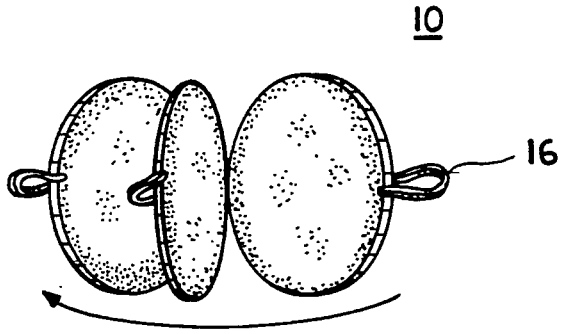
Figure 5C:
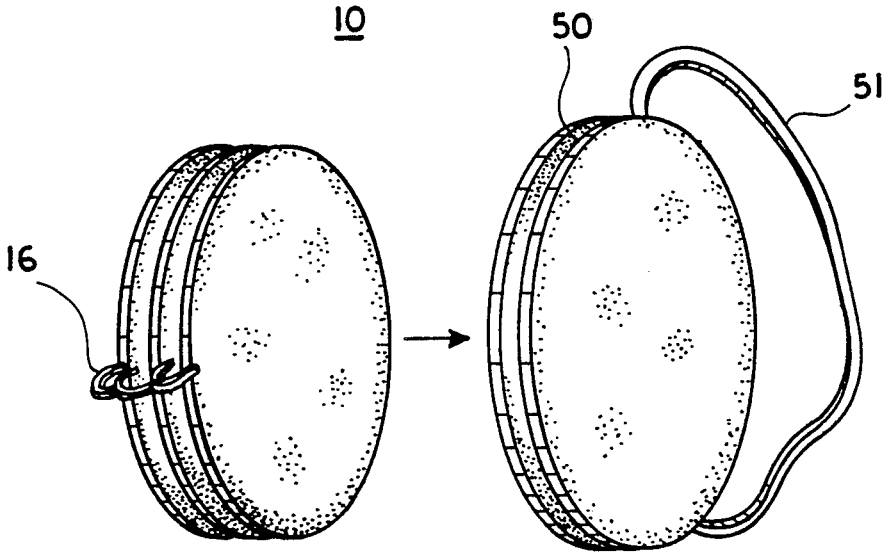

The sheet of material 43 that forms the roof of the shelter 30 can be directly sewn onto the poles 33 of the frame 31 or affixed with VELCRO straps. The preferred material is a NYLON-DACRON mesh that is commonly used in tent materials because of its ability to shed water and its lightness. Loosening the bolt and wingnut 41,42 allows the shelter halves **30*a*,30*b* to be folded accordion fashion. The mat 11 itself can be folded due to the flexibility of the band 15 similar to a folded band saw blade. This will reduce the mat 11 down to ⅓ its normal size that can be stored in a carrying pouch with a carrying strap 51 as shown in FIGS. 5*a*–5*c*. This pouch 50 can be easily toted to a park or beach and the mat 11** can then be unfolded and the shelter can be erected if desired.

It is to be understood that the present invention is not limited to the sole embodiment described above, but encompasses any and all embodiments within the scope of the following claims.

I claim:

1. A folding mat for use on a beach, pool or park, including:

a first horizontal sheet of waterproof material forming a flat surface;

an outer edge to said horizontal sheet;

a flexible band of non-compressible material disposed about said outer edge of said horizontal sheet, said band allowing said sheet to be collapsed, but retains the shape of said sheet when flat;

a plurality of loops disposed about said outer edge for inserting tent stakes through to maintain said sheet in position;

a central aperture disposed on said sheet of material for the insertion of an umbrella stand:

an elastic band disposed about said central aperture in order to keep said aperture tightly engaged with said umbrella stand;

a second sheet of fabric material disposed over said sheet of waterproof material; whereby said first sheet provides a soft, dry cushion to lay upon and said second sheet provides a non-irritating surface.

2. The mat according to claim 1, wherein:

said first sheet is composed of a resilient foam material.

3. The mat according to claim 2, wherein:

said resilient foam material is neoprene rubber.

4. The mat according to claim 1, wherein:

said flexible band of non-compressible material is made of spring steel.

5. The mat according to claim 1, wherein:

said flexible band of non-compressible material is made of high impact plastic.

6. The mat according to claim 1, wherein:

a flap is attached to the side of said central aperture capable of being disposed over said central aperture in order to prevent sand and dirt from leaking through said central aperture.

7. The mat according to claim 1, wherein:

said band of flexible material is sewn into a hem disposed along said outer edge of said first sheet.

8. The mat according to claim 1, including:

at least two outer apertures disposed at substantially opposite ends of said first and second sheets, said outer apertures being for the insertion of tent stake assemblies that support a shelter frame.

9. The mat according to claim 8, including:

tent stake assemblies inserted through said outer apertures, said tent stake assemblies having opposite ends, one said end being inserted into the ground and the other end having disposed thereon a plurality of hollow tubes that are pivotally mounted to said other end;

a plurality of elongated flexible shafts having opposite ends disposed in one each of said hollow tubes, said elongated flexible shafts spanning the distance between said at least two tent stake assemblies to form a shelter frame;

a sheet of shelter material disposed over said shelter frame.

10. The mat according to claim 9, including:

four outer apertures arranged in pairs at substantially opposite ends of said first and second sheets;

four tent stake assemblies, said tent stake assemblies arranged pairs at substantially opposite ends of said first and second sheets of material;

two of said shelter frames disposed between said tent stake assemblies, said shelter frames facing in opposite directions;

a sheet of shelter material disposed over each said shelter frame.

11. The mat according to claim 9, wherein:

said tent stake assemblies are pivotally mounted together by a bolt, washer and wingnut capable of tightening and loosening said tent stake assemblies.

* * * * *